US010927709B2

(12) United States Patent
Muldoon et al.

(10) Patent No.: US 10,927,709 B2
(45) Date of Patent: Feb. 23, 2021

(54) TURBINE BEARING STACK LOAD BYPASS NUT

(71) Applicant: United Technologies Corporation, Farmington, CT (US)

(72) Inventors: Marc J. Muldoon, Marlborough, CT (US); Gregory E. Reinhardt, South Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 184 days.

(21) Appl. No.: 16/000,223

(22) Filed: Jun. 5, 2018

(65) Prior Publication Data

US 2019/0368379 A1 Dec. 5, 2019

(51) Int. Cl.

| | |
|---|---|
| ***F01D 25/16*** | (2006.01) |
| ***F01D 5/06*** | (2006.01) |
| ***F01D 5/02*** | (2006.01) |

(52) U.S. Cl.

CPC ..... *F01D 25/16* (2013.01); *F01D 5/025* (2013.01); *F01D 5/066* (2013.01); *F05D 2230/60* (2013.01); *F05D 2240/55* (2013.01); *F05D 2260/31* (2013.01)

(58) Field of Classification Search

CPC ..... F01D 5/066; F01D 5/026; F01D 5/025; F01D 25/16; F02C 7/06; F02C 7/20

See application file for complete search history.

(56) References Cited

U.S. PATENT DOCUMENTS

| | | | | |
|---|---|---|---|---|
| 2,772,102 | A * | 11/1956 | Webb | F16L 15/001 285/334 |
| 3,916,495 | A * | 11/1975 | Klassen | F01D 5/066 29/888.011 |
| 3,997,962 | A * | 12/1976 | Kleitz | B23P 19/06 29/426.5 |
| 5,472,313 | A * | 12/1995 | Quinones | F01D 5/082 415/115 |
| 5,537,814 | A * | 7/1996 | Nastuk | F01D 5/066 60/796 |
| 8,517,687 | B2 * | 8/2013 | Benjamin | F01D 5/066 416/198 A |
| 8,932,011 | B2 | 1/2015 | Mundell et al. | |
| 9,212,557 | B2 * | 12/2015 | Benjamin | F01D 5/066 |

(Continued)

FOREIGN PATENT DOCUMENTS

| | | |
|---|---|---|
| EP | 0472170 A2 | 2/1992 |
| EP | 2365185 A2 | 9/2011 |
| EP | 2821657 A1 | 1/2015 |

OTHER PUBLICATIONS

European Search Report for European Application No. 19178531.0 dated Sep. 19, 2019.

*Primary Examiner* — Justin D Seabe

(74) *Attorney, Agent, or Firm* — Carlson, Gaskey & Olds, P.C.

(57) ABSTRACT

A gas turbine includes a shaft, a turbine coupled with the shaft for rotation with the shaft, and a bearing coupled with the shaft to facilitate rotation of the shaft. A bearing nut is adjacent the bearing on the shaft. The turbine has a first load path and the bearing has a second load path. The bearing nut exerts a force on the bearing such that the first load path is not aligned with the second load path relative to a central axis of the gas turbine engine. A method of assembling a gas turbine engine is also disclosed.

20 Claims, 5 Drawing Sheets

(56) References Cited

U.S. PATENT DOCUMENTS

| | | | | |
|---|---|---|---|---|
| 2010/0158699 | A1 | 6/2010 | Makuszewski | |
| 2014/0010648 | A1* | 1/2014 | Muldoon | F01D 25/16 415/230 |
| 2014/0017087 | A1 | 1/2014 | Benjamin et al. | |
| 2016/0237857 | A1 | 8/2016 | Hanrahan et al. | |

* cited by examiner

TURBINE BEARING STACK LOAD BYPASS NUT

BACKGROUND

Gas turbine engines generally include rotating elements (rotors), such as fans, turbines, and compressors arranged on respective spools or shafts. Bearings facilitate rotation of the shafts. During engine operation, the rotors create various loads with respect to the shafts and bearings. In some configurations, adjacent rotors and bearings have load paths that are aligned with one another, and the bearings must withstand the loads.

SUMMARY

A gas turbine engine according to an example of the present disclosure includes a shaft, a turbine coupled with the shaft for rotation with the shaft, and a bearing coupled with the shaft to facilitate rotation of the shaft. A bearing nut is adjacent the bearing on the shaft. The turbine has a first load path and the bearing has a second load path. The bearing nut exerts a force on the bearing such that the first load path is not aligned with the second load path relative to a central axis of the gas turbine engine.

In a further embodiment according to any of the foregoing embodiments, the turbine is a high pressure turbine and the shaft is a high speed spool.

In a further embodiment according to any of the foregoing embodiments, the bearing nut is arranged between the turbine and the bearing.

In a further embodiment according to any of the foregoing embodiments, the bearing nut and the shaft each include threads. The threads are configured to locate the bearing nut with respect to the shaft.

In a further embodiment according to any of the foregoing embodiments, the threads have a square profile.

In a further embodiment according to any of the foregoing embodiments, at least one of an oil scoop and a seal are adjacent the bearing.

In a further embodiment according to any of the foregoing embodiments, an anti-rotation feature is configured to prevent rotation of the bearing nut with respect to at least one of the turbine and the bearing.

In a further embodiment according to any of the foregoing embodiments, the anti-rotation feature is a spline.

A gas turbine engine according to an example of the present disclosure includes a shaft, a compressor coupled with the shaft for rotation with the shaft, and a turbine coupled with the shaft for rotation with the shaft. A forward bearing and an aft bearing are coupled with the shaft to facilitate rotation of the shaft. A bearing nut is adjacent the aft bearing on the shaft. The turbine has a first load path and the bearing has a second load path. The bearing nut exerts a force on the aft bearing such that the first load path is not aligned with the second load path relative to a central axis of the gas turbine engine.

In a further embodiment according to any of the foregoing embodiments, the aft bearing is arranged between the turbine and the compressor.

In a further embodiment according to any of the foregoing embodiments, the compressor is a high pressure compressor, the turbine is a high pressure turbine, and the shaft is a high speed spool.

In a further embodiment according to any of the foregoing embodiments, the aft bearing is aft of the turbine.

In a further embodiment according to any of the foregoing embodiments, the bearing nut and the shaft each include threads, the threads are configured to locate the bearing nut with respect to the shaft.

A method of assembling a gas turbine engine according to an example of the present disclosure includes installing a bearing on a shaft and installing a turbine on the shaft. A bearing nut is installed on the shaft adjacent to the bearing and the turbine. The turbine has a first load path and the bearing has a second load path. The bearing nut exerts a force on the aft bearing such that the first load path is not aligned with the second load path relative to a central axis of the gas turbine engine.

In a further embodiment according to any of the foregoing embodiments, the bearing nut is installed on the shaft after the bearing is installed on the shaft, and the bearing nut compresses the bearing in a forward direction.

In a further embodiment according to any of the foregoing embodiments, the bearing nut and shaft each include threads configured to locate the bearing nut with respect to the shaft. After the bearing nut is installed on the shaft, a gap is formed between an aft side of the threads of the bearing nut and a forward side of the threads of the shaft.

In a further embodiment according to any of the foregoing embodiments, the turbine is installed on the shaft after the bearing and bearing nut are installed on the shaft.

In a further embodiment according to any of the foregoing embodiments, after the turbine is installed on the shaft, a gap is formed between a forward side of the threads of the bearing nut and an aft side of the threads of the shaft.

In a further embodiment according to any of the foregoing embodiments, the turbine is installed on the shaft prior to the bearing stack being installed on the shaft.

In a further embodiment according to any of the foregoing embodiments, the turbine is a high pressure turbine and the shaft is a high speed spool.

DETAILED DESCRIPTION

Figure 1:
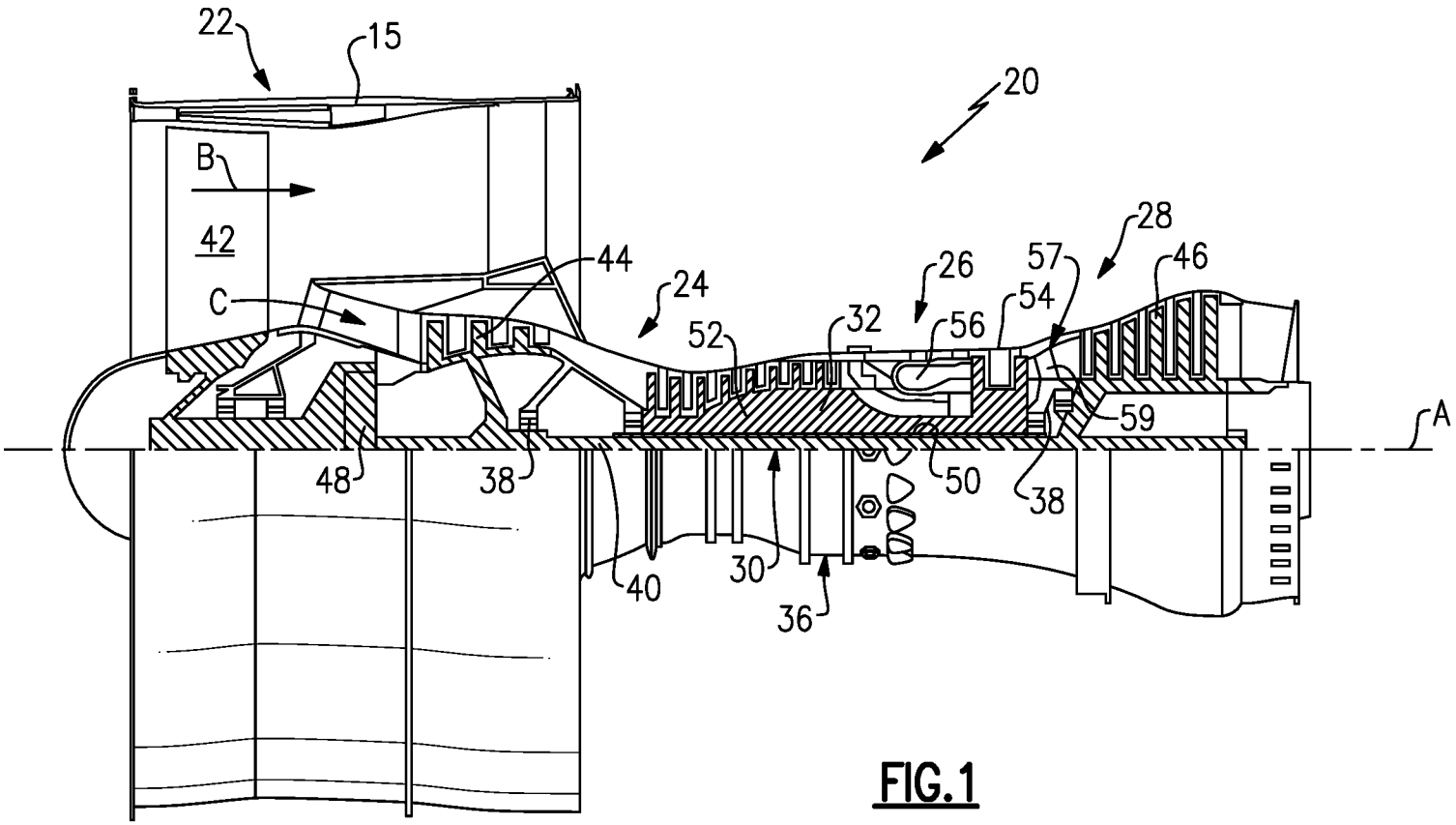
FIG. 1 schematically illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of 1 bm of fuel being burned divided by 1 bf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]0.5. The "Low corrected fan tip speed" as disclosed herein according to one non-limiting embodiment is less than about 1150 ft/second (350.5 meters/second).

Figure 2A:
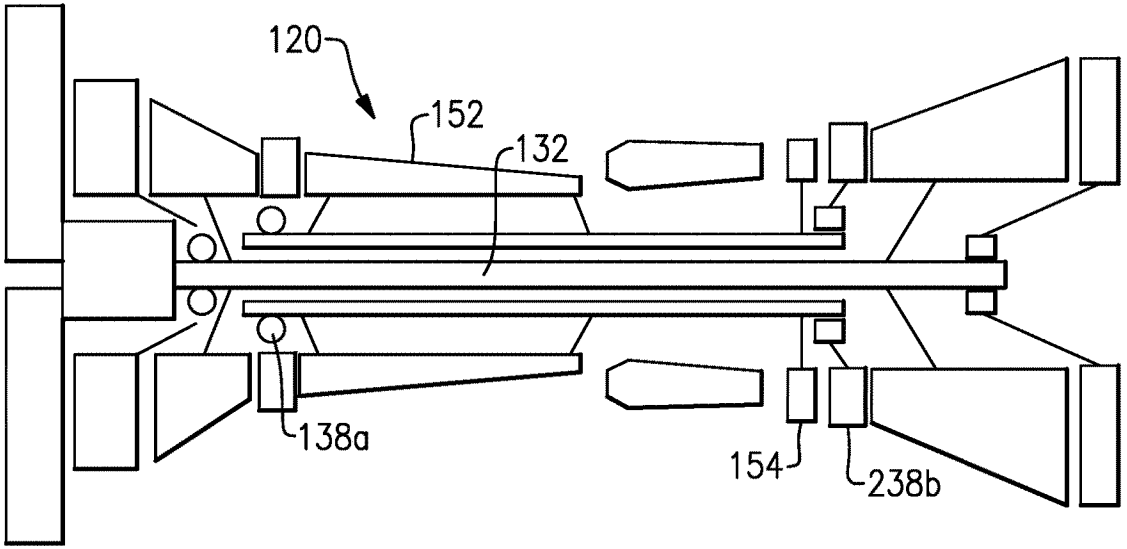
FIG. 2A schematically illustrates a gas turbine engine with a straddle-mounted core configuration.
Figure 2B:
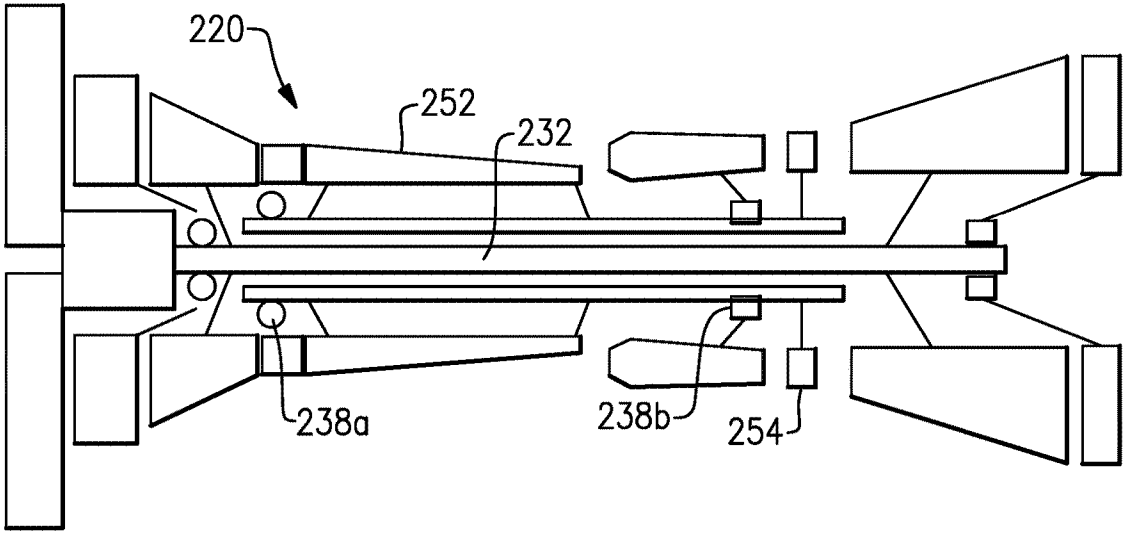
FIG. 2B schematically illustrates a gas turbine engine with an overhung turbine configuration.

FIGS. 2A and 2B show simplified example engines with different bearing system arrangements. FIG. 2A-B provide context for explaining the engine arrangement with a bearing nut, discussed below and shown in FIGS. 4-5B. In these examples, the pictured shaft corresponds to the high speed spool 32 of engine 20, the pictured turbine corresponds to the the high speed turbine 54 of engine 20, and the pictured compressor corresponds to the high pressure compressor 52 of engine 20. However, it should be understood that in other examples for other engine architectures, the shaft, turbine, and compressor can be other shafts, turbines, and compressors within the engine 20.

FIG. 2A shows an example engine 120 with a "straddle-mounted core." In this example, a forward bearing 138*a* is arranged at a forward end of the shaft 132 and an aft bearing 138*b* is arranged at an aft end of the shaft 132, with which a high pressure compressor 152 and high pressure turbine 154 rotate. FIG. 2B shows an example engine 220 with an "overhung turbine." In this example, a forward bearing 238*a* is arranged at a forward end of the shaft 232, and an aft bearing 238*b* is arranged between the high pressure turbine 254 and the high pressure compressor 252.

Figure 3:
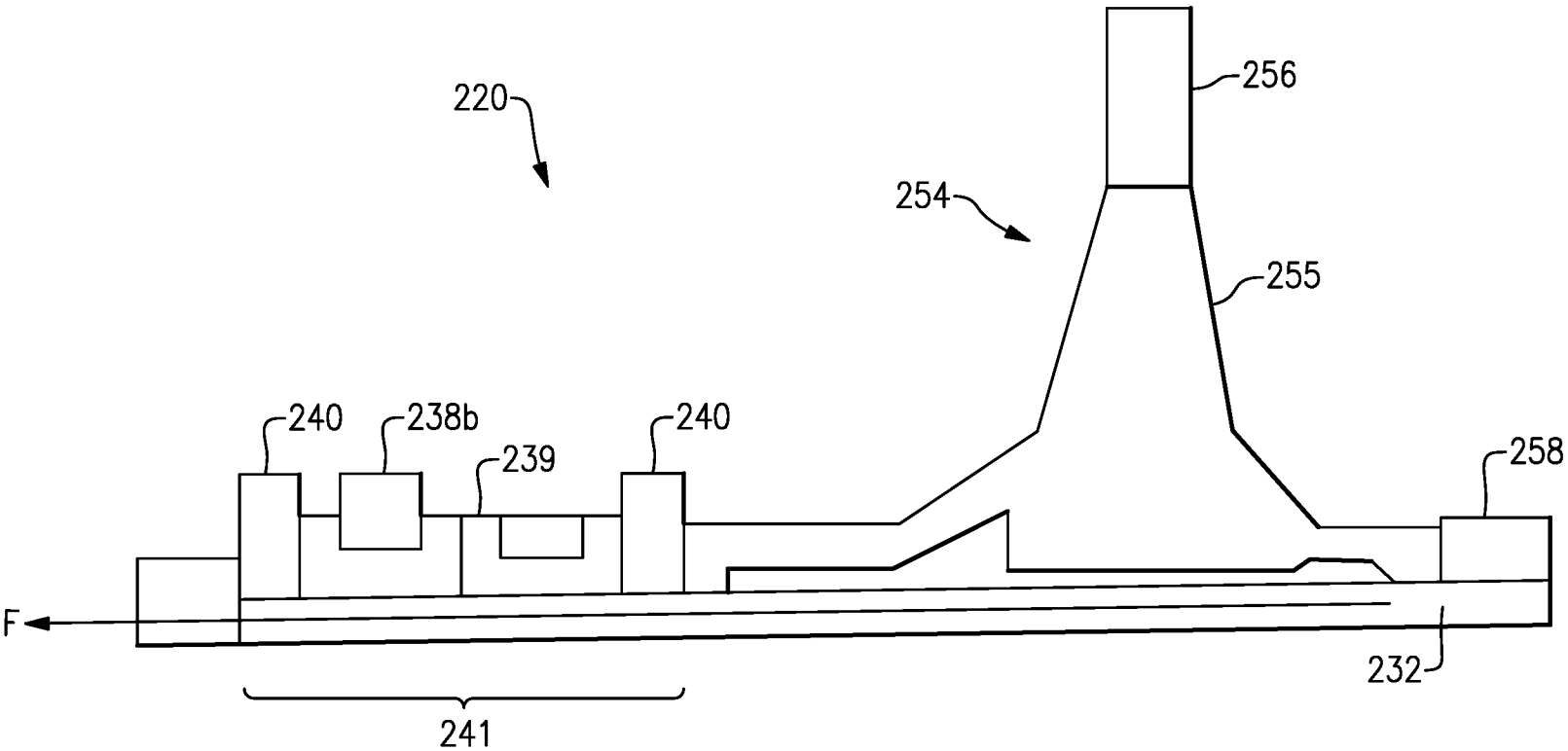
FIG. 3 schematically illustrates a detail view of a bearing stack and turbine of the example engine of FIG. 2B.

FIG. 3 shows a detail view of the overhung turbine configuration of FIG. 2B. As shown, the turbine 254 includes a turbine hub 255 and turbine blades 256 that rotate with the shaft 232. Forward of the turbine 254 is the aft bearing 238*b*. Adjacent the aft bearing 238*b* is an oil scoop 239 which provides lubrication to the bearing 238*b*. Seal plates 240 are arranged on either side of the aft bearing 238*b* and the oil scoop 239. Collectively, the seal plates 240, aft bearing 238*b*, and oil scoop 239 form a "bearing stack" 251. Aft of the turbine 254 is a turbine load nut 258.

During engine operation, forces due to rotation, thermal expansion/contraction, and relative movement of various engine components act on the turbine 254, the bearing stack 251, and the shaft 232 and affect the total compressive load in the turbine 254, bearing stack 251, or other component load path. For example, as the engine 220 changes temperature during start-up, operation, and cool-down, the turbine 254 undergoes thermal expansion/contraction with respect to or the shaft 232. Dimensional changes experienced by the turbine 254 can both increase and decrease the "stack" or compressive load applied to the turbine 254 and/or bearing stack 251 such that design criteria such as minimum turbine 254 load or maximum bearing stack 251 load may be challenged. These forces collectively are characterized as forces along a load path. These forces collectively are also characterized as forces along a load path.

Figure 2C:
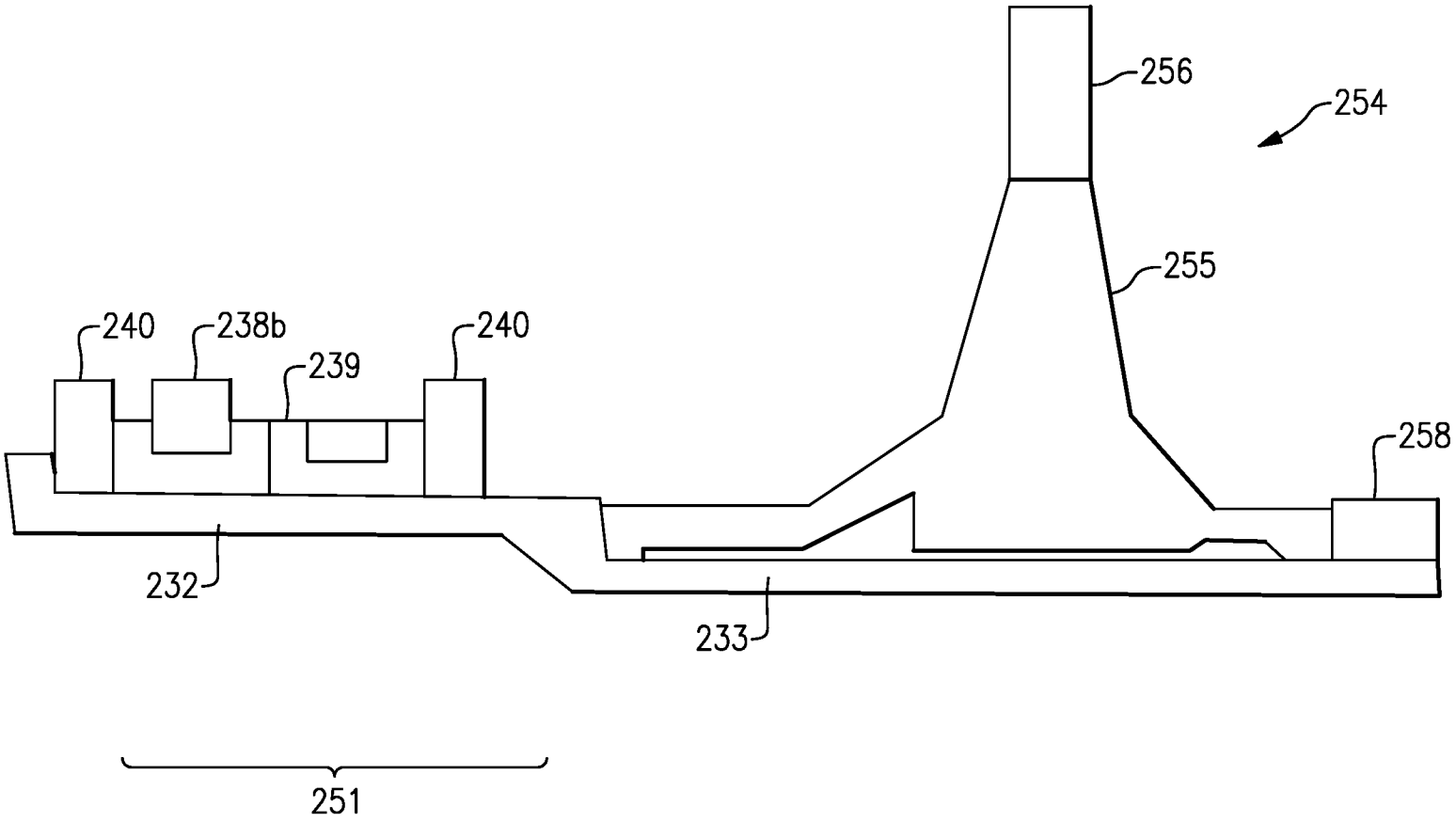
FIG. 2C schematically illustrates a gas turbine engine with an offset shaft.

In FIG. 3, the turbine 254 and aft bearing 238*b* have a common load path F. That is, the load paths of the forces discussed above for the turbine 254 and the aft bearing 238*b* lie on a common axis with respect to a central axis A of the engine 220. The load required to keep the high pressure turbine 254 hub seated on the shaft 232 can exceed the load capacity of the aft bearing 238*b* and its associated seals 240 and/or oil scoops 239. In this configuration, the aft bearings 238*b* experience a load that exceeds the load capacity of the aft bearings 238*b*. This can lead to aft bearing 238*b* rollers becoming pinched, seals 240 becoming distorted, or the oil scoop 239 reaching its stress limits. One approach to prevent overloading of the aft bearings 238*b* is to mount the turbine 254 on a shaft 233 that is offset from the shaft 232 that the bearings 238*b* is mounted on, as shown in FIG. 2C for the overhung turbine configuration. However, this configuration requires more space and has an increased weight as compared to the arrangement of FIGS. 2A-B.

Figure 4:
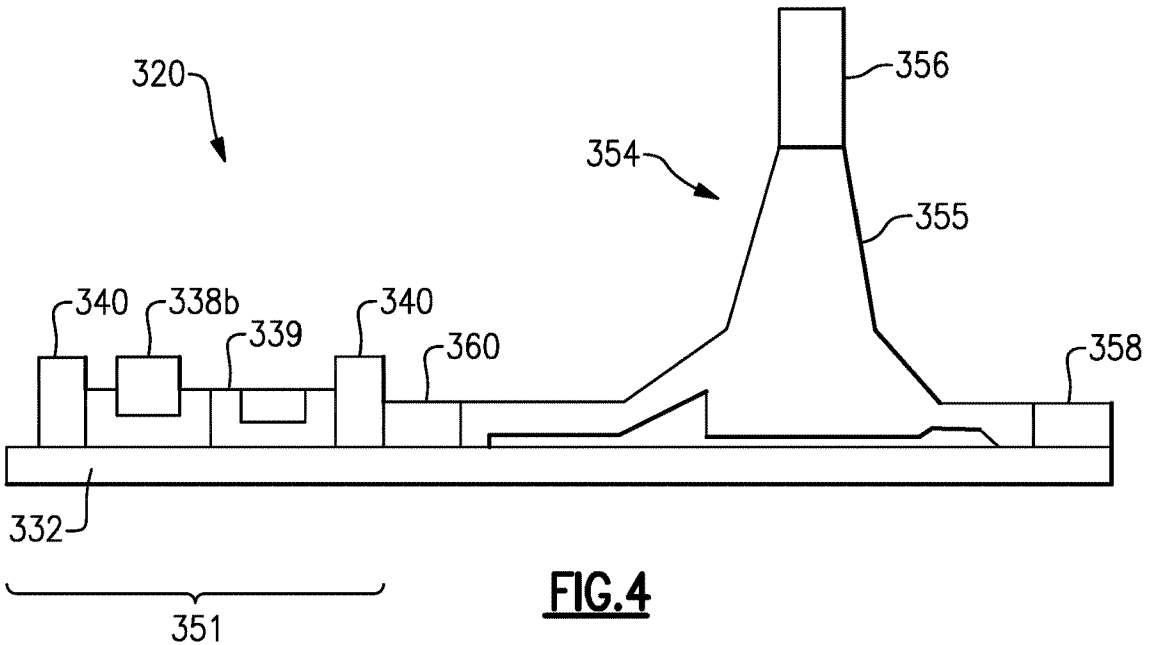
FIG. 4 schematically illustrates a detail view of a bearing stack and turbine of an example engine with a bearing nut.
Figure 5B:
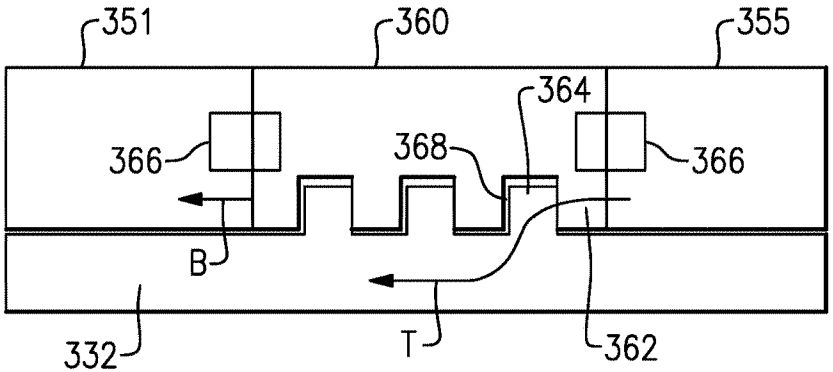
FIG. 5B schematically illustrates a detail view of the bearing nut of FIG. 4 in an operating position.

Though the foregoing description of turbine/aft bearing common load path F was made with respect to the overhung turbine configuration of FIG. 2B, an engine with the straddle-mounted configuration of FIG. 2A can experience the same turbine/aft bearing common load path. Furthermore, the following description will be made with respect to an example engine 320 as shown in FIGS. 4-5B, which has the overhung turbine engine configuration. However, it should be understood that the same description applies to the straddle-mounted core engine configuration or other engine configurations. That is, the particular location of the below-described bearing stack, bearing nut, turbine stack, and turbine nut along the shaft are not limited to the embodiments shown in the Figures.

Referring to FIG. 4, the example engine 320 includes an aft bearing 338*b*, an oil scoop 339 adjacent the aft bearing 338*b*, and seal plates 340 on either side of the aft bearing 338*b* and oil scoop 339. Collectively, the seal plates 340, aft bearing 338*b*, and oil scoop 339 form a "bearing stack" 351. The example engine also includes a turbine 354 rotatable about the shaft 332 with a turbine hub 355 and turbine blades 356, and a turbine nut 358 aft of the turbine 354.

The example engine 320 also includes a bearing nut 360 between the bearing stack 351 and turbine 354. The bearing nut 360 separates the load from the turbine 354 from other loads borne by the bearing stack 351 by exerting a force on the bearing stack 351. That is, the bearing nut 360 prevents overloading of the bearing stack 351 with the turbine 354 load path.

In this example, the bearing nut 360 is between the turbine 354 and bearing stack 351. However, in other example engine configurations, the bearing nut 360, the turbine 354, and the bearing stack 351 can have different configurations in relation to one another along the shaft 332. Still, the bearing nut 360 prevents overloading of the bearing stack 351 with the turbine 354 load path.

Figure 5A:
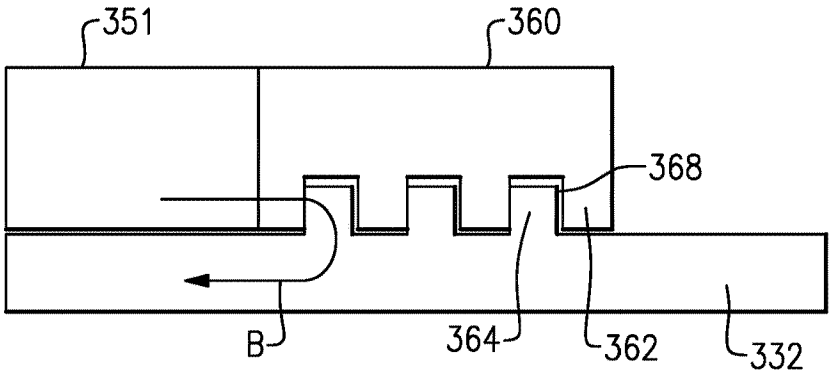
FIG. 5A schematically illustrates a detail view of the bearing nut of FIG. 4 in an initial position.

FIGS. 5A-B shows a schematic detail view of the bearing nut 360. The bearing nut 360 has threads 362 that interact with threads 364 on the shaft 332 to locate the bearing nut 360 with respect to the shaft 332. In the example shown, the threads 362, 364 are square threads, but in other examples the threads can have other profiles.

FIG. 5A shows the bearing nut 360 and bearing stack 351 installed on the shaft 332 for initial compression of the bearing stack in the forward direction (e.g., an "initial position"). During installation, the bearing nut 360 and bearing stack 351 are positioned in such a way that the threads 362 of the bearing nut 360 are forced in an aft direction against the threads 364 of the shaft 332, leaving a gap 368 between an aft side of threads 362 of the bearing nut 360 and a forward side of the threads 364 of the shaft 332. As shown, the bearing stack 351 load path B is aftward against the bearing nut 360 and aligned with the bearing nut 360, but the initial compression forces the bearing nut 360 forwards as discussed above, and in this position the bearing stack 351 load path B is reversed in a forwards direction along the shaft 332.

FIG. 5B shows the bearing nut 360 installed on the shaft 332 after the turbine 354 is installed. The turbine 354 is installed in such a way that the threads 362 of the bearing nut 360 are forced in a forward direction against the threads 364 of the shaft 332, leaving a gap 368 between a forward side of threads 362 of the bearing nut 360 and an aft side of the threads 364 of the shaft 332. When the engine 320 operates, the bearing nut 360 is in the position shown in FIG. 5B. As shown, the bearing load B and turbine 354 load path T are not co-axial with each other, as in the above-described examples.

As shown in FIG. 5B, in the operating position where the bearing nut 360 is forced forwards, the bearing nut 360 exerts a force on the bearing stack 351 such that the overall bearing load path B is offset from the shaft 332 and instead is in line with the bearing nut 360. The turbine load path T is coaxial with the bearing load path B near the bearing nut 360, but ultimately becomes aligned with the shaft 332, as in previous examples (FIG. 2A-2B). Effectively, the bearing nut 360 separates the loads B, T by exerting a force on the bearing stack 351 which is separate from forces exerted by the turbine 354. The separation of the loads B, T by the bearing nut 360 in this manner prevents over-loading of the bearing stack 351, as discussed above. Furthermore, this configuration does not require more space, nor does it add significant weight to the engine 320.

Though in the example of FIGS. 5A-B, the bearing stack 351 is initially installed on the shaft 332 prior to the turbine 354, in another example, the turbine 354 can be installed prior to the bearing stack 351. In this example, the location of the threads 362, 264 and gaps 368 is reversed in the initial and operating positions.

In some examples, the bearing nut 360 has an anti-rotation feature 366, such as a spline, with respect to the turbine hub 355 and/or the bearing stack 351. The anti-rotation feature 366 keeps the bearing nut 360 positioned relative to the turbine hub 355 and/or bearing stack 351 such that the separation of load paths B, T as discussed above is maintained. In particular, the anti-rotation feature 366 prevents the bearing nut 360 from rotating with respect to the turbine hub 355 and/or bearing stack 351.

The bearing nut 360 can comprise any high strength, hard material, such as a nickel-based alloy. The bearing nut 360 can also include a corrosion-resistant coating, such as a chromium-based coating or any other know corrosion-resistant coating.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can be determined by studying the following claims.

What is claimed is:

1. A gas turbine engine, comprising:

a shaft;

a turbine in a turbine section coupled with the shaft for rotation with the shaft;

a turbine nut on the shaft aft of the turbine;

a bearing in the turbine section coupled with the shaft to facilitate rotation of the shaft; and a bearing nut on the shaft forward of the turbine in the turbine section, wherein the turbine has a first load path and the bearing has a second load path, and wherein the bearing nut exerts a force on the bearing such that the first load path is not aligned with the second load path relative to a central axis of the gas turbine engine, wherein the first and second load paths are in the forward direction.

2. The gas turbine engine of claim 1, wherein the turbine is a high pressure turbine and the shaft is a high speed spool.

3. The gas turbine engine of claim 1, wherein the bearing nut is arranged between the turbine and the bearing.

4. The gas turbine engine of claim 1, wherein the bearing nut and the shaft each include threads, the threads configured to locate the bearing nut with respect to the shaft.

5. The gas turbine engine of claim 4, wherein the threads have a square profile.

6. The gas turbine engine of claim 1, further comprising at least one of an oil scoop and a seal adjacent the bearing.

7. The gas turbine engine of claim 1, further comprises an anti-rotation feature configured to prevent rotation of the bearing nut with respect to at least one of the turbine and the bearing.

8. The gas turbine engine of claim 7, wherein the anti-rotation feature is a spline.

9. A gas turbine engine, comprising:

a shaft;

a compressor coupled with the shaft for rotation with the shaft;

a turbine coupled with the shaft for rotation with the shaft;

a turbine nut on the shaft aft of the turbine;

a forward bearing and an aft bearing coupled with the shaft to facilitate rotation of the shaft; and a bearing nut on the shaft forward of the turbine, wherein the turbine has a first load path and the aft bearing has a second load path, and wherein the bearing nut exerts a force on the aft bearing such that the first load path is not aligned with the second load path relative to a central axis of the gas turbine engine, and wherein the first and second load paths are in a forward direction.

10. The gas turbine engine of claim 9, wherein the aft bearing is arranged between the turbine and the compressor.

11. The gas turbine engine of claim 10, wherein the compressor is a high pressure compressor, the turbine is a high pressure turbine, and the shaft is a high speed spool.

12. The gas turbine engine of claim 9, wherein the aft bearing is aft of the turbine.

13. The gas turbine engine of claim 9, wherein the bearing nut and the shaft each include threads, the threads configured to locate the bearing nut with respect to the shaft.

14. A method of assembling a gas turbine engine, comprising:

installing a bearing on a shaft in a turbine section;

installing a turbine on the shaft in the turbine section;

installing a turbine nut on the shaft aft of the turbine; and installing a bearing nut on the shaft forward of the turbine in the turbine section, such that the turbine has a first load path in a forward direction and the bearing has a second load path in a forward direction, and wherein the bearing nut exerts a force on the aft bearing such that the first load path is not aligned with the second load path relative to a central axis of the gas turbine engine.

15. The method of claim 14, wherein the bearing nut is installed on the shaft after the bearing is installed on the shaft, and the bearing nut compresses the bearing in a forward direction.

16. The method of claim 15, wherein the bearing nut and shaft each include threads configured to locate the bearing nut with respect to the shaft, and wherein after the bearing nut is installed on the shaft, a gap is formed between an aft side of the threads of the bearing nut and a forward side of the threads of the shaft.

17. The method of claim 16, wherein the turbine is installed on the shaft after the bearing and bearing nut are installed on the shaft.

18. The method of claim 17, wherein after the turbine is installed on the shaft, a gap is formed between a forward side of the threads of the bearing nut and an aft side of the threads of the shaft.

19. The method of claim 14, wherein the turbine is installed on the shaft prior to the bearing stack being installed on the shaft.

20. The method of claim 14, wherein the turbine is a high pressure turbine and the shaft is a high speed spool.

* * * * *